US007836904B1

(12) United States Patent
Cushman

(10) Patent No.: US 7,836,904 B1
(45) Date of Patent: Nov. 23, 2010

(54) WALKING CANE APPARATUS

(76) Inventor: Ella M. Cushman, 1923 Overhill Rd., Charlotte, NC (US) 28211

( * ) Notice: Subject to any disclaimer, the term of this patent is extended or adjusted under 35 U.S.C. 154(b) by 0 days.

(21) Appl. No.: 12/474,154

(22) Filed: May 28, 2009

(51) Int. Cl.
*A45B 3/10* (2006.01)

(52) U.S. Cl. ..... 135/66; 135/65; 248/205.3; 248/218.4

(58) Field of Classification Search ..... 135/16, 135/65, 66, 911; 248/205.2, 205.3, 218.4; D3/5–11
See application file for complete search history.

(56) References Cited

U.S. PATENT DOCUMENTS

| | | | | | |
|---|---|---|---|---|---|
| 370,496 | A | * | 9/1887 | Seliger | 446/404 |
| 1,827,862 | A | * | 10/1931 | Weber | 135/66 |
| 2,269,029 | A | * | 1/1942 | Lounsbery | 359/516 |
| 4,428,390 | A | * | 1/1984 | Baird | 135/66 |
| 4,858,125 | A | * | 8/1989 | Washizuka et al. | 600/301 |
| 5,056,545 | A | | 10/1991 | Spaeth | |
| D325,297 | S | * | 4/1992 | Lipscomb et al. | D3/7 |
| 5,642,749 | A | | 7/1997 | Perryman | |
| 6,000,414 | A | * | 12/1999 | Crusor | 135/66 |
| 6,502,283 | B1 | | 1/2003 | Aguirre | |
| 6,691,722 | B2 | * | 2/2004 | Hutchinson et al. | 135/65 |
| 7,174,907 | B2 | | 2/2007 | Goldsmith et al. | |
| 2003/0136436 | A1 | * | 7/2003 | Stepp | 135/66 |
| 2004/0020524 | A1 | * | 2/2004 | McConnell | 135/66 |
| 2007/0251559 | A1 | * | 11/2007 | Yu | 135/66 |
| 2008/0072940 | A1 | | 3/2008 | Cheng et al. | |
| 2008/0110482 | A1 | | 5/2008 | Granziera | |
| 2008/0289671 | A1 | * | 11/2008 | Chiu | 135/65 |
| 2010/0006128 | A1 | * | 1/2010 | Lamoureux | 135/65 |

* cited by examiner

*Primary Examiner*—Winnie Yip
(74) *Attorney, Agent, or Firm*—Crossley Patent Law; Mark A. Crossley

(57) ABSTRACT

The walking cane apparatus securely carries a portable device within or without a case. Any appropriate portable device may be transported, including but not limited to such items as a cell phone, a blood pressure monitor, a media player, and a blood sugar monitor, to name but a few. The device is removably carried so that changing of devices and instant removal are easily accomplished. Devices are disposed in an easily accessible position on the apparatus staff, proximal to the handle. By positioning the carry of portable devices strategically, apparatus use in assisting an individual's mobility is not encumbered. The cane apparatus also carries a portable device attractively.

1 Claim, 2 Drawing Sheets

FIG. 1
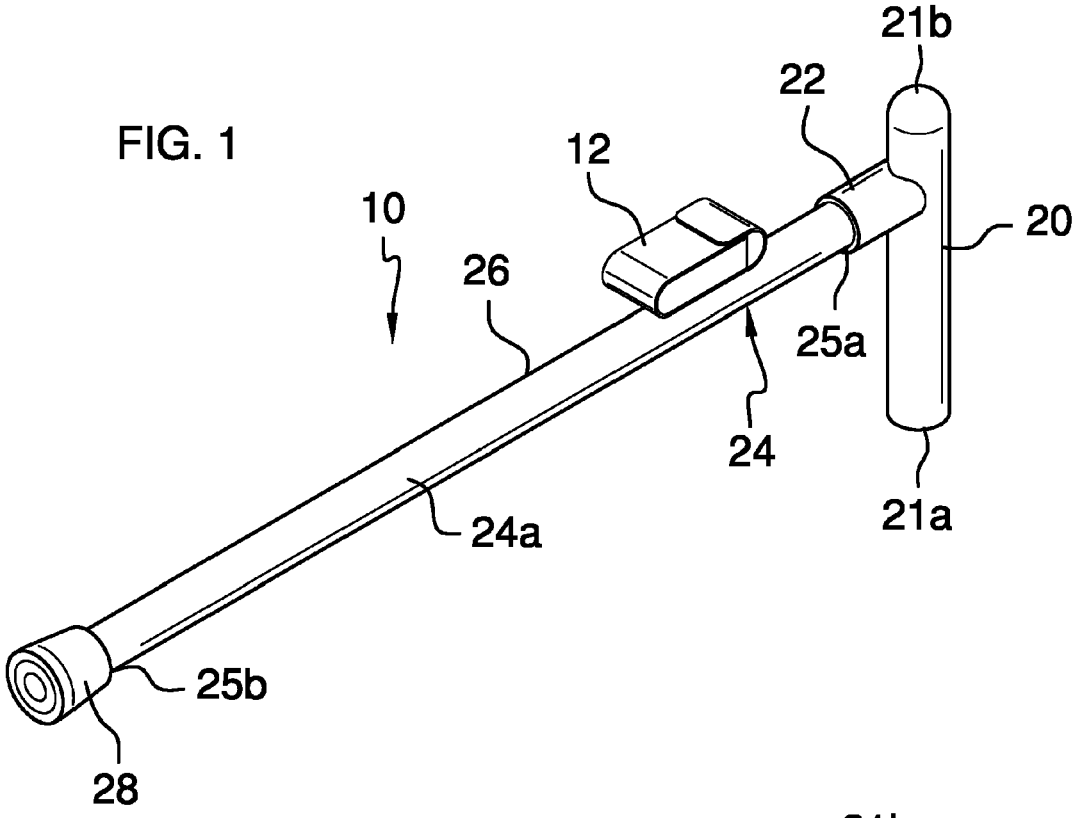
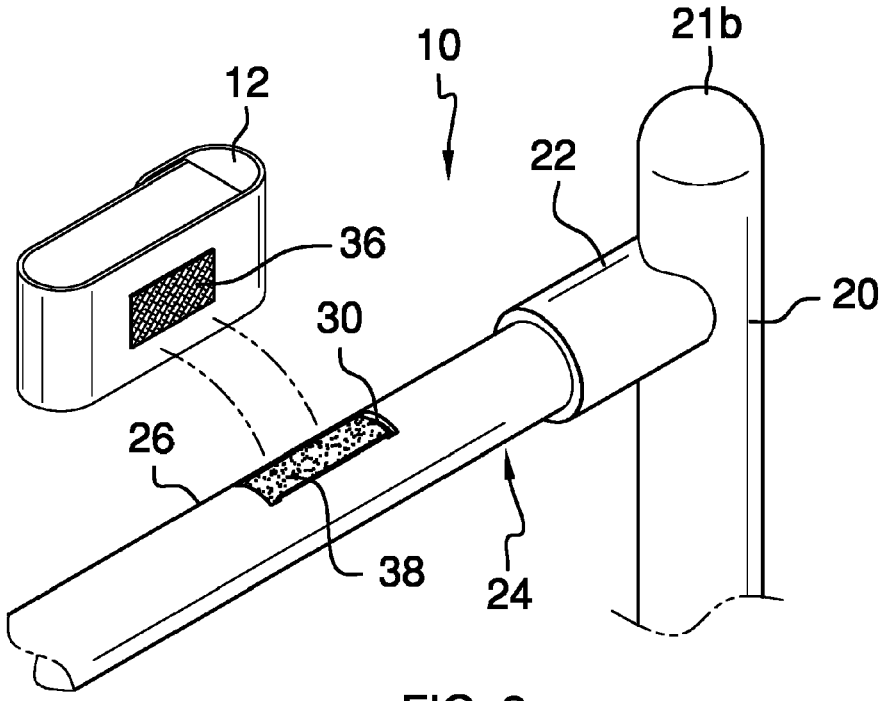
FIG. 2

WALKING CANE APPARATUS

BACKGROUND OF THE INVENTION

Those of us who use a cane to assist in mobility find ourselves with at least one hand occupied with the cane. Often, the other hand may be occupied in carrying groceries, a purse, a briefcase, or any of a host of other items. In today's world, cell phones have become almost indispensable. Other items often carried include blood pressure monitors, and blood sugar testing devices, to name but a few. However, remembering to also include such devices as one more carry item, or even having enough hands to do so, can find us without that item. The present apparatus solves this problem with a cane adapted for easily and securely carrying a portable electronic device removably affixed on the cane.

FIELD OF THE INVENTION

The walking cane apparatus relates to walking canes and more especially to a walking cane that removably carries a relatively small portable electronic device, such as a cell phone for example.

SUMMARY OF THE INVENTION

The general purpose of the walking cane apparatus, described subsequently in greater detail, is to provide a walking cane apparatus which has many novel features that result in an improved walking cane apparatus which is not anticipated, rendered obvious, suggested, or even implied by prior art, either alone or in combination thereof.

To attain this, the walking cane apparatus securely carries a portable device. The apparatus carries a device within or without a case via hook and loop. Any appropriate portable device may be transported, including but not limited to such items as a cell phone, a blood pressure monitor, a media player, and a blood sugar monitor, to name but a few. The device is removably carried so that changing of devices and instant removal are easily accomplished. Devices are disposed in an easily accessible position on the apparatus staff, proximal to the handle. By positioning the carry of portable devices strategically, apparatus use in assisting an individual's mobility is not encumbered. The cane apparatus also carries a portable device attractively.

Of further importance is that the loop is disposed within and on the apparatus in a loop attachment design that does not risk loss of any portable device carried.

Thus has been broadly outlined the more important features of the improved walking cane apparatus so that the detailed description thereof that follows may be better understood and in order that the present contribution to the art may be better appreciated.

An object of the walking cane apparatus is to securely carry a portable device.

Another object of the walking cane apparatus is to removably carry a portable device.

A further object of the walking cane apparatus is to carry a portable device in an easily accessible position on the apparatus.

An added object of the walking cane apparatus is to carry a portable device in a position on the apparatus that does not interfere with cane apparatus use.

And, an object of the walking cane apparatus is to carry a portable device attractively.

These together with additional objects, features and advantages of the improved walking cane apparatus will be readily apparent to those of ordinary skill in the art upon reading the following detailed description of presently preferred, but nonetheless illustrative, embodiments of the improved walking cane apparatus when taken in conjunction with the accompanying drawings.

In this respect, before explaining the current embodiments of the improved walking cane apparatus in detail, it is to be understood that the walking cane apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved walking cane apparatus. It is therefore important that the claims be regarded as including such equivalent constructions insofar as they do not depart from the spirit and scope of the walking cane apparatus. It is also to be understood that the phraseology and terminology employed herein are for purposes of description and should not be regarded as limiting.

BRIEF DESCRIPTION OF THE DRAWINGS

FIG. 1 is a perspective view of the apparatus carrying a portable electronic device in case.

FIG. 2 is a perspective view of the removable attachment of the portable device of FIG. 1.

DETAILED DESCRIPTION OF THE DRAWINGS

Figure 3:
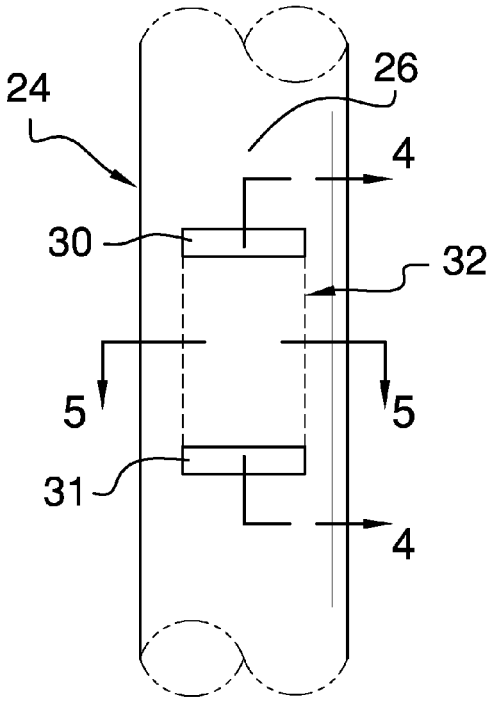
FIG. 3 is a lateral elevation view of the staff, with first and second slots.

With reference now to the drawings, and in particular FIGS. 1 through 5 thereof, the principles and concepts of the walking cane apparatus generally designated by the reference number 10 will be described.

Referring to FIGS. 1 and 2, the apparatus 10 partially comprises the rounded handle 20 having a first end 21*a* spaced apart from a second end 21*b*. The gusset 22 is perpendicularly affixed proximal to the handle 20 second end 21*b*. The staff 24 has a staff first end 25*a* spaced apart from a staff second end 25*b*, and a length 24*a* therebetween. The staff 24 further comprises a surface 26. The staff first end 25*a* is affixed to the gusset 22. The tip protector 28 is disposed on the staff second end 25*b*.

Referring to FIG. 3 and continuing to refer to FIG. 2, the pair of spaced apart slots is disposed in the staff 24. The slots are disposed proximal to the staff first end 25*a*. The slots are perpendicular to the staff 24 length 24*a*. The slots comprise the first slot 30 and the second slot 31.

Figure 4:
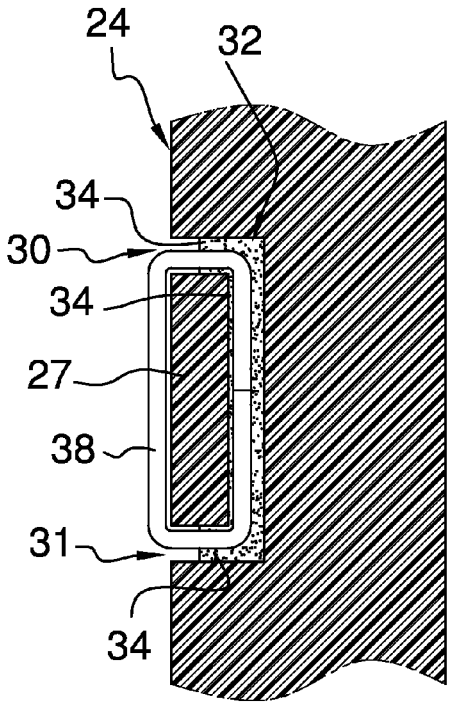
FIG. 4 is a cross sectional view of FIG. 3, taken along the line 4-4.
Figure 5:
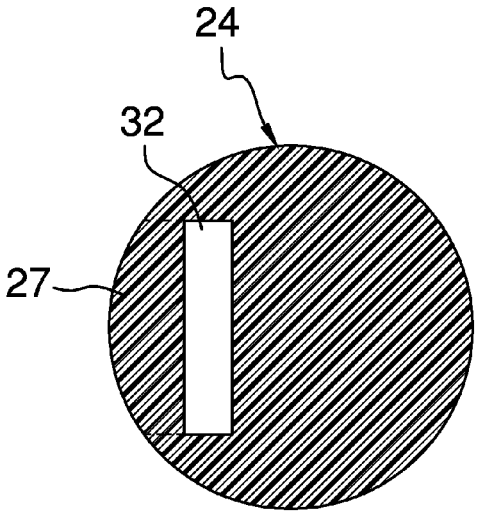
FIG. 5 is a cross sectional view of FIG. 3, taken along the line 5-5.

Referring to FIGS. 4 and 5 and continuing to refer to FIG. 3, the pathway 32 is disposed within the staff 24 length 24*a*. The pathway 32 connects the slots under the staff 24 surface 26. The pathway forms a staff 24 section 27. The section 27 continues to form a perimeter of the staff 24, with staff 24 interruption only via the slots and the pathway 32. Loop 38 of hook and loop is disposed through the slots, the pathway 32 and on the section 27. Adhesive 34 secures the loop 38 to the section 27 and to the pathway 32.

Referring again to FIG. 1, Hook 36 of hook and loop is affixed to an existing portable device case 12 or even such a device without a case 12.

With respect to the above description then, it is to be realized that the optimum dimensional relationships for the parts of the walking cane apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the walking cane apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the walking cane apparatus may be used.

Therefore, the foregoing is considered as illustrative only of the principles of the walking cane apparatus. Further, since numerous modifications and changes will readily occur to those skilled in the art, it is not desired to limit the walking cane apparatus to the exact construction and operation shown and described, and accordingly, all suitable modifications and equivalents may be resorted to, falling within the scope of the walking cane apparatus.

What is claimed is:

1. A walking cane apparatus, comprising:

a rounded handle having a first end spaced apart from a second end;

a gusset perpendicularly affixed proximal to the handle second end;

a staff having a staff first end spaced apart from a staff second end, a length therebetween, a surface, the staff first end affixed to the gusset;

a pair of spaced apart slots disposed in the staff, the slots proximal to the staff first end, the slots perpendicular to the staff length, the slots comprising a first slot and a second slot;

a pathway disposed within the staff length, the pathway connecting the slots under the staff surface;

a separated section of the staff disposed in the pathway and continues to form a perimeter of the staff;

a first loop strip of hook and loop fastener disposed through the slots, the pathway and on the section, an adhesive disposed in the slots and the pathway and securing the first loop strip to the section and to the pathway;

a tip protector disposed on the staff second end; and a second hook strip of hook and loop fastener affixed to an existing portable device, wherein the second hook strip is securable to the first loop strip to removably attach the existing portable device on the staff.

* * * * *